US007269970B2

(12) United States Patent
Robertson

(10) Patent No.: US 7,269,970 B2
(45) Date of Patent: Sep. 18, 2007

(54) COOLER WITH INDIVIDUAL CONTAINER POCKETS

(75) Inventor: James David Robertson, Atlanta, GA (US)

(73) Assignee: Display Industries, LLC, Norcross, GA (US)

( * ) Notice: Subject to any disclaimer, the term of this patent is extended or adjusted under 35 U.S.C. 154(b) by 284 days.

(21) Appl. No.: 11/047,031

(22) Filed: Jan. 31, 2005

(65) Prior Publication Data

US 2006/0168992 A1 Aug. 3, 2006

(51) Int. Cl.
*F25D 3/08* (2006.01)

(52) U.S. Cl. ..... 62/457.5

(58) Field of Classification Search .... 62/457.2–457.7, 62/371, 372, 458; 206/427
See application file for complete search history.

(56) References Cited

U.S. PATENT DOCUMENTS 5,007,250 A * 4/1991 Musielak ..... 62/372
5,095,718 A * 3/1992 Ormond et al. ..... 62/457.5
5,423,195 A * 6/1995 Peters ..... 62/457.7
6,360,558 B1 * 3/2002 Woog ..... 62/457.5
6,425,498 B1 * 7/2002 Gheorgheos ..... 222/78
6,463,756 B1 * 10/2002 Lewis ..... 62/457.7
6,564,992 B1 * 5/2003 Wegner ..... 229/117.35
6,631,803 B2 * 10/2003 Rhodes et al. ..... 206/427
6,769,268 B2 * 8/2004 Gano, III ..... 62/457.2
6,851,276 B2 * 2/2005 Perrins ..... 62/457.5
6,862,896 B1 * 3/2005 Seidl ..... 62/457.4
6,886,357 B2 * 5/2005 Gano et al. ..... 62/239
6,918,257 B2 * 7/2005 Slone et al. ..... 62/3.61

* cited by examiner

*Primary Examiner*—Mohammad M. Ali
(74) *Attorney, Agent, or Firm*—John L. James

(57) ABSTRACT

A transportable cooler comprises a bottom panel having lateral and transverse edge portions and a plurality of upright panels attached thereto and extending upward therefrom forming a vessel with an interior adapted to hold fluid. The plurality of upright panels includes a front panel having a front surface and plurality of pockets extending from the front surface to the interior of the vessel. A lid provides access to the interior for filling the cooler with ice. The ice cools each pocket to chill a beverage container inserted in the pocket.

12 Claims, 4 Drawing Sheets

COOLER WITH INDIVIDUAL CONTAINER POCKETS

TECHNICAL FIELD OF THE INVENTION

This invention relates generally to a cooler, and, more particularly, to a cooler for beverage containers for use with ice.

BACKGROUND OF THE INVENTION

Coolers for use with ice are used in convenience stores and other commercial environments to place containers of beverages for easy access by consumers. Ice coolers typically take the form of a barrel or chest positioned near a store entrance, near the cash register, at the end of an isle or other locations to spur an impulse purchase. These containers are filled with ice and the beverage containers are placed on the ice and onto the ice. As the ice melts, the beverage containers sink forcing a consumer to fish around in the ice for the desired container. In addition to having a cold, wet hand, which is unpleasant, the consumer is sometimes exposed to germ-laden water. Barrel and chest coolers also have the disadvantage of placing the beverage containers at waist level instead of at eye level. It is desirable to have a cooler wherein melting ice does not wet the beverage containers and contaminate the water or containers.

A problem with barrel and chest coolers is capacity. Typically, capacity is limited by the barrel or chest opening. A barrel opening increases in size with barrel diameter which is limited by distance between aisles, or, when located at the end of an aisle, by shelf width. Similarly, a chest opening is limited by shelf width. It is therefore desirable to have a cooler whose capacity is not limited by shelf width or distance between shelves.

Another problem with chest and barrel coolers is the inability to remove a single container without disturbing remaining containers. It is therefore desirable to have a cooler wherein containers can be removed, one at a time, without disturbing the remaining containers.

SUMMARY OF THE INVENTION

The present invention is directed to overcoming one or more of the problems set forth above. Briefly summarized, according to one aspect of the present invention, a cooler comprises a bottom panel having lateral and transverse edge portions and a plurality of upright panels attached thereto and extending upward therefrom forming a vessel with an interior adapted to hold fluid. The plurality of upright panels includes a front panel having a front surface and plurality of pockets extending from the front surface to the interior of the vessel.

When the vessel is filled with ice, the pockets are cooled thereby cooling containers in the pockets. Spent water is drained from the bottom portion of the vessel. Wheels provided a means for moving the cooler about on a merchandise floor. Removing the wheels allows the cooler to be conveniently placed on a table or countertop. When used on a table or countertop, a flat lid provides a space for displaying items complimentary to the beverages, such as chip, snack foods and the like. A bottom compartment can be used for a pump to pump spent water from the vessel or can be used for refrigeration equipment when it is preferred over ice.

The pockets allow an individual container to be inserted or removed with disturbing the other containers. The pockets isolate the container from the ice and water so that the containers are not wet by the water and there is no possibility of contamination. Because the containers are isolated from the ice and water, the water does not wet the of a consumer when the consumer removes a container.

Arranging the pockets in various shapes, such as a familiar beverage bottle, increases visual appeal to help spur an impulse purchase. The pockets can be of different sizes so that a single cooler unit can hold several brands and sizes of containers. A portion of a container can extend beyond the surface of the cooler to aid in product identification.

These and other aspects, objects, features and advantages of the present invention will be more clearly understood and appreciated from a review of the following detailed description of the preferred embodiments and appended claims, and by reference to the accompanying drawings wherein similar reference numerals have been used, where possible, to designate similar or identical features that are common to the figures.

DETAILED DESCRIPTION OF THE PREFERRED EMBODIMENTS

Figure 1:
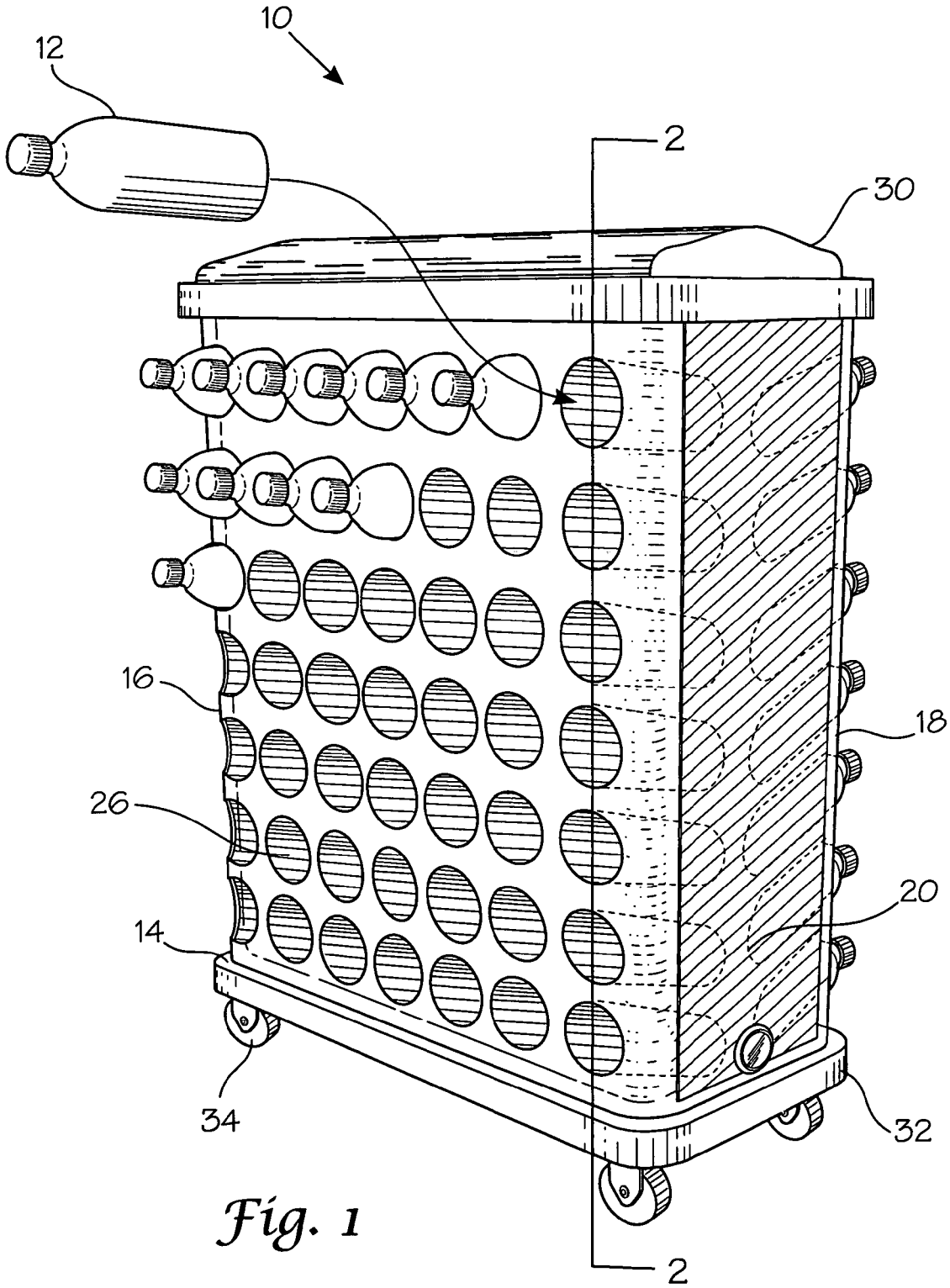
FIG. 1 is a perspective view of a preferred embodiment of a cooler with pockets for containers according to the present invention.
Figure 2:
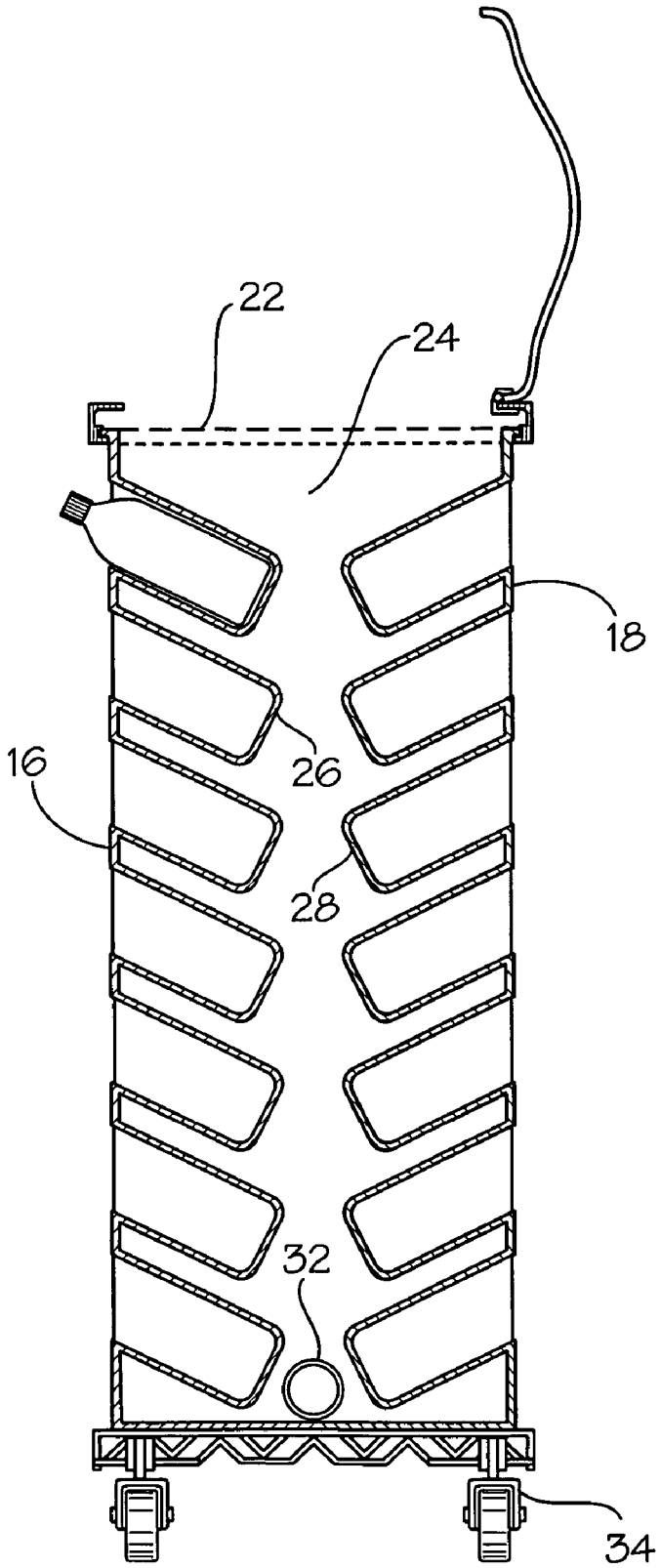
FIG. 2 is a sectional view of the cooler taken along line 2-2 of FIG. 1.

Referring to FIGS. 1-2, a cooler 10 is provided for cooling beverage containers 12 or other items. Cooler 10 has a bottom or base panel 14 and a plurality of upright panels forming a vessel capable of holding water. Bottom panel 14 has lateral and transverse edge portions and is polygonal shaped. Preferably bottom panel 14 is rectangular in shape with a front edge portion, a rear edge portion and side edge portions, but may be triangular or other shapes. In a retail environment, a triangular shape is especially adapted for the end of a row of shelving or alongside a row of shelving allowing access to beverage containers from two sides. A rectangular shape is preferable at the end of a row of shelving because it protrudes less from the end of the shelving while holding more containers.

The plurality of upright panels includes a front panel 16 attached to base panel 14 and extending upward therefrom. Similarly a rear panel 18 and end panels 20, 22 also attach to base panel 14 and extend upward forming a vessel with an interior 24 adapted to hold fluid. Naturally, the number of upright panels will match the number of edge portions of bottom panel 14. Front panel 16 has an exterior front surface and plurality of pockets 26 extending from the exterior front surface to the interior 24 of the vessel. Similarly, rear panel 18 has an exterior surface and plurality of pockets 28 extending from the exterior surface to the interior 24 of the vessel. Pockets 26, 28 are shown arranged in rows and columns but may be arranged in any order. Each pocket is preferably spaced from adjacent pockets to facilitate contact with the cooling medium.

Still referring to FIGS. 1-2, cooler 10 has a lid 30 preferably hingedly attached to rear panel 18. Alternatively, lid 30 may simply rest atop the upright panels in a recess formed therein. Lid 30 may have a contoured configuration for aesthetic appeal or may be planar. Lid 30 swings open to provide access to the interior 20 of the cooler for adding ice for cooling. Lid 30 may be spaced from the topmost pockets to provide more space for ice. When added, ice will fill some of the spaces between the pockets. As the ice melts, water will fill voids between pockets and provide contact for heat transfer from the pockets. As the pockets cool, the containers in the pockets will also cool. To retard heat loss through the upright panels, interior panel surfaces not having a pocket can be insulated with foam, double walled construction, or a spray on insulating coating. In addition, the portions of the pockets immediately adjacent an insulated surface may also be insulated.

A drain pipe 32 disposed along the bottom of the vessel collects water and is used to drain the vessel through a drain opening in one of the bottom or upright panels. Drain pipe 32 is preferably perforated so that it does not clog with ice particles. When the ice melts and the vessel is filled with water, it is time to drain the water. Water may be drained at other times as is convenient.

A plurality of coasters or wheels 34 are mounted on base panel 14 for easy transport of the cooler from one location on a merchandise floor to another.

Figure 3:
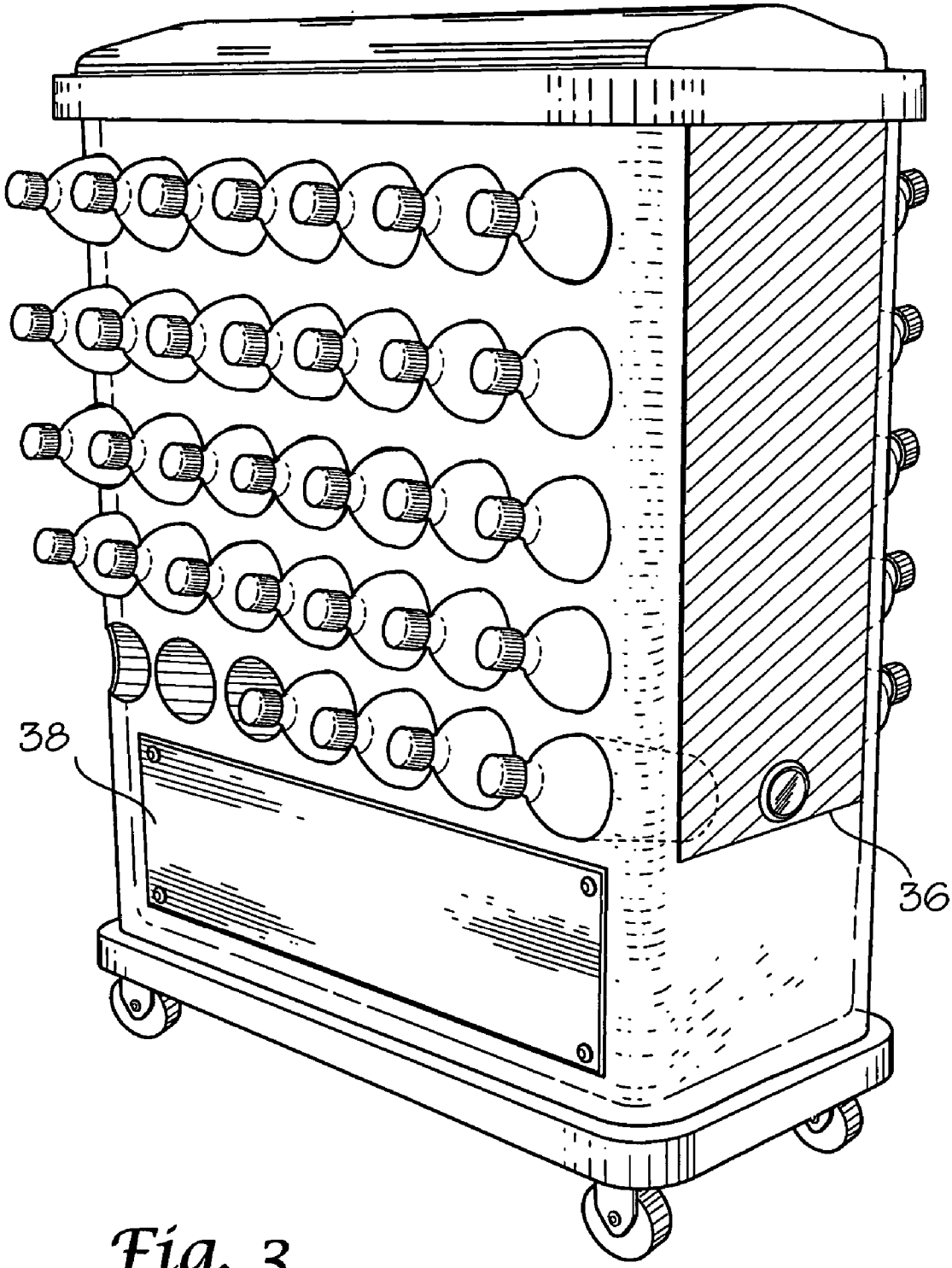
FIG. 3 is a perspective view of a cooler similar to FIG. 1 but having a lower access panel.

Referring now to FIG. 3, instead of ice, the vessel may be filled with a fluid, such as air or water, to be used for cooling by conventional refrigeration means (not shown) carried in a bottom compartment below the pockets. A divider panel 36 divides the cooler into an upper fluid holding vessel and a lower compartment for refrigeration equipment. One of the upright panels, the front panel as illustrated, has an access panel 38 adapted to provide access to the lower compartment. This configuration eliminates the chore of periodically changing the ice. Where it is desired or most practical to use ice, the bottom compartment can be used to store additional containers instead of refrigeration equipment. Such stored containers would be at a temperature cooler than room temperature and always ready for insertion into available pockets.

Figure 4:
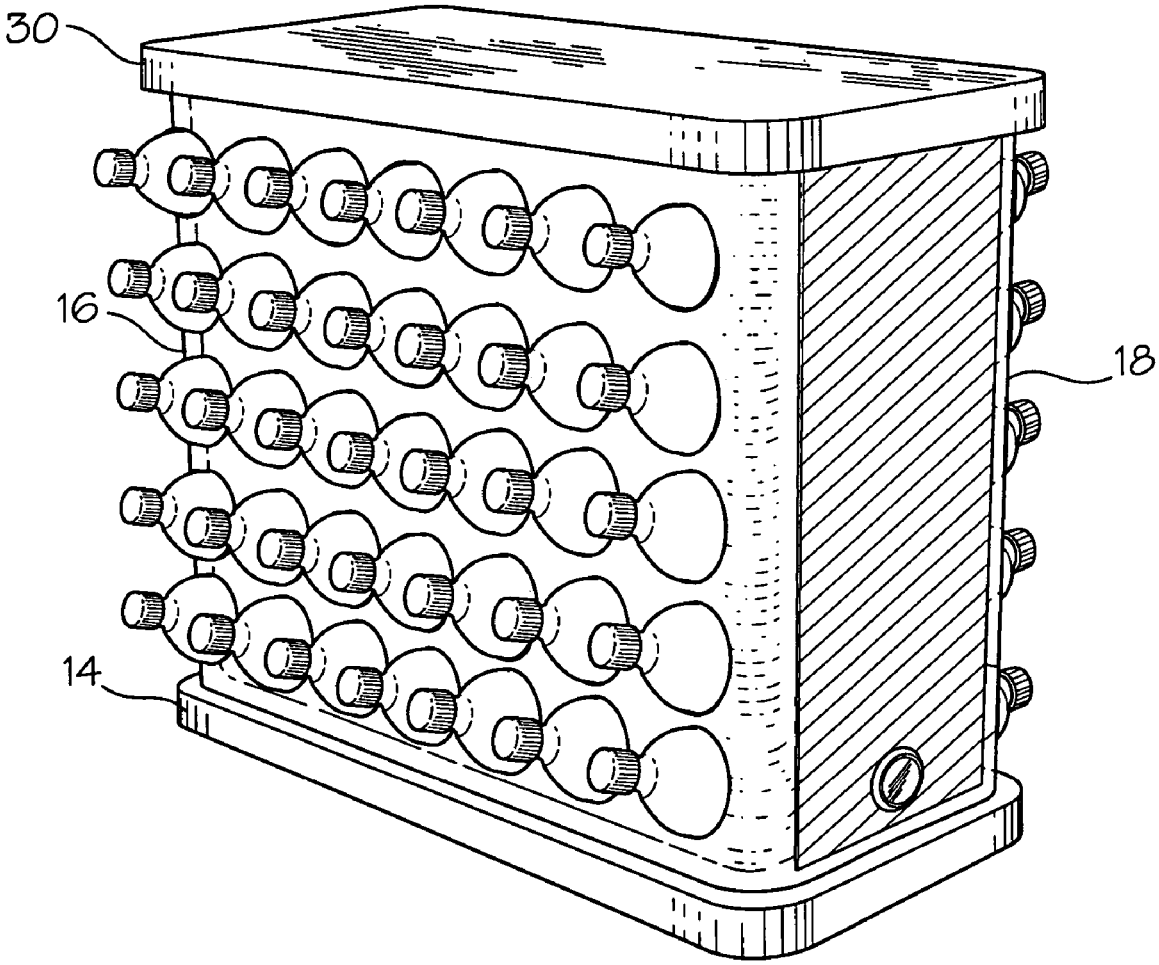
FIG. 4 is a perspective view of another preferred embodiment of a cooler according to the present invention featuring a display panel attached to support ribs.

Referring now to FIG. 4, the cooler 10 may be shortened to fit on a tabletop or countertop where all containers are at eye level. In this case, lid 30 should be planar and the top surface used for displaying chips, nuts or other items complimentary to the beverages available in the pockets.

While the invention has been described with particular reference to the preferred embodiments, it will be understood by those skilled in the art that various changes may be made and equivalents may be substituted for elements of the preferred embodiments without departing from invention. For example, the pockets can be arranged to resemble the contour of familiar beverage containers instead of the rows and columns illustrated. Also, while ice and onboard refrigeration equipment have been described, water or other cooling fluid could be piped to the cooler. It is accordingly intended that the claims shall cover all such modifications and applications as do not depart from the true spirit and scope of the invention.

ELEMENT LIST

10 cooler
12 beverage containers
14 base panel
16 front panel
18 rear panel
20, 22 end panels
24 interior of water holding vessel
26 front pockets
28 rear pockets 28
30 lid
32 drain pipe
34 wheels
36 divider panel
38 access panel

What is claimed is:

1. A cooler, comprising:

a bottom panel having lateral and transverse edge portions;

a plurality of upright panels including a front panel each having an interior surface and an exterior surface, said plurality of upright panels being attached to said lateral and transverse edge portions of said bottom panel and extending upward from said bottom panel with said interior surfaces forming a vessel adapted to hold fluid; and a plurality of front pockets formed in said front panel extending from said exterior surface of said front panel toward said interior surface of said front panel into said vessel.

2. A cooler, as set forth in claim 1, including a lid mounted atop said plurality of upright panels adapted to provide access to said interior of said vessel.

3. A cooler, as set forth in claim 2, wherein said lid is hingedly connected to one of said upright panels.

4. A cooler, as set forth in claim 2, wherein said lid is removably mounted atop said plurality of upright panels.

5. A cooler, as set forth in claim 1, wherein one of said bottom panel and upright panels contains a drain opening.

6. A cooler, as set forth in claim 5, including a drain pipe in said interior of said vessel adapted to direct fluid to said drain opening.

7. A cooler, as set forth in claim 1, wherein said bottom panel has a polygonal configuration.

8. A cooler, as set forth in claim 1, including a plurality of wheels mounted on said bottom panel.

9. A cooler, as set forth in claim 1, including a divider panel in said interior dividing said interior into upper and lower chambers wherein said upper chamber is adapted to hold fluid.

10. A cooler, as set forth in claim 9, wherein one of said upright panels has an access panel adapted to provide access to said lower chamber.

11. A cooler, as set forth in claim 1, wherein said plurality of upright panels includes a rear panel having interior and exterior surfaces; and a plurality of rear pockets formed in said rear panel extending from said exterior surface of said rear panel toward said interior surface of said rear panel into said vessel.

12. A cooler, comprising:

a bottom panel having lateral and transverse edge portions;

a plurality of upright panels each having an interior surface and an exterior surface, said plurality of upright panels being attached to said lateral and transverse edge portions of said bottom panel and extending upward from said bottom panel with said interior surfaces forming a vessel adapted to hold fluid;

a plurality of front pockets formed in a front panel of said plurality of panels extending from an exterior surface of said front panel toward an interior surface of said front panel into said vessel;

a lid mounted atop at least one of said upright panels and adapted to provide access to said vessel; and a plurality of rear pockets formed in a rear panel of said plurality of panels extending from an exterior surface of said rear panel toward an interior surface of said rear panel into said vessel.

* * * * *